United States Patent [19]

Endo et al.

[11] 4,418,660

[45] Dec. 6, 1983

[54] PLASMA IGNITION SYSTEM USING PHOTOTHYRISTORS FOR INTERNAL COMBUSTION ENGINE

[75] Inventors: Hiroshi Endo; Masazumi Sone; Iwao Imai; Yasuki Ishikawa, all of Yokosuka, Japan

[73] Assignee: Nissan Motor Company, Limited, Kanagawa, Japan

[21] Appl. No.: 367,036

[22] Filed: Apr. 7, 1982

[30] Foreign Application Priority Data

Apr. 7, 1981 [JP] Japan ..... 56-51262

[51] Int. Cl.[3] ..... F02P 1/00

[52] U.S. Cl. ..... 123/143 B; 123/596; 123/605; 123/606; 123/633; 123/640; 123/643; 123/653

[58] Field of Search ..... 123/143 B, 596, 594, 123/604, 597, 612, 613, 618, 640, 643, 653

[56] References Cited

U.S. PATENT DOCUMENTS

| | | | |
|---|---|---|---|
| Re. 30,426 | 11/1980 | Haslett | 123/143 B |
| 3,780,343 | 12/1973 | Stonham | 123/596 |
| 3,788,293 | 6/1974 | Anderson | 123/620 |
| 3,835,830 | 9/1974 | Shepard | 123/620 |
| 4,366,801 | 1/1983 | Endo et al. | 123/596 |
| 4,369,758 | 1/1983 | Endo et al. | 123/596 |

FOREIGN PATENT DOCUMENTS

| | | | |
|---|---|---|---|
| 208576 | 4/1982 | United Kingdom | 123/143 B |

*Primary Examiner*—Raymond A. Nelli

*Attorney, Agent, or Firm*—Lowe, King, Price & Becker

[57] ABSTRACT

A plasma ignition system for an internal combustion engine, which comprises: (a) a low DC voltage power supply; (b) a DC-DC converter which converts a low DC voltage from the low DC voltage supply to the corresponding AC voltage and inverts the AC voltage to a high DC voltage; (c) a plurality of plasma ignition plugs each located within one of the cylinders; (d) a plurality of first capacitors each for changing the high DC voltage received from the DC-DC converter; (e) a plurality of photosensitive switching elements each connected between each corresponding first capacitor and ground and which turns on to apply the plasma ignition energy charged within the corresponding first capacitor to the corresponding plasma ignition plug at a predetermined timing; (f) a plurality of voltage-boosting transformers each having a common terminal of primary and secondary windings connected to one terminal of each corresponding plasma ignition energy capacitor and another terminal of the primary winding connected to the corresponding plasma ignition plug for boosting the voltage across the corresponding first capacitor to a still higher voltage at the secondary winding thereof depending on the winding ratio therebetween; (g) a plurality of second capacitors connected between another terminal of the secondary winding of each voltage-boosting transformer and ground so as to form an oscillation circuit together with the primary winding of the corresponding transformer;

(h) an ignition timing pulse signal generator which sequencially produces an electrical ignition timing signal for igniting each of the plasma ignition plugs at the predetermined timing according to the engine revolution; and (i) a plurality of light emitting elements each connected to the ignition timing pulse signal generator which emits a light for triggering the corresponding photo-sensitive switching element to turn on in response to electrical timing signal from the ignition timing pulse signal generator.

6 Claims, 4 Drawing Figures

PLASMA IGNITION SYSTEM USING PHOTOTHYRISTORS FOR INTERNAL COMBUSTION ENGINE

BACKGROUND OF THE INVENTION

Field of the Invention

The present invention relates to a plasma ignition system using photo semiconductor devices for an internal combustion engine having a plurality of cylinders.

SUMMARY OF THE INVENTION

It is an object of the present invention to provide a plasma ignition system for igniting fuel supplied into each cylinder of an internal combustion engine, wherein each photo-sensitive switching element turns on to apply the ignition energy charged within each corresponding ignition energy capacitor and boosted by each corresponding transformer to corresponding plasma ignition plug in response to a light trigger signal emitted via an optical fiber from a light emitting element connected to a plasma ignition timing signal generator in response to an ignition timing signal produced therefrom, so that false triggering for the photo-thyristors due to the high-frequency noise generated when the ignition plug is ignited can be eliminated because of their noise-resistant characteristics.

DETAILED DESCRIPTION OF THE PREFERRED EMBODIMENT

Reference will be made hereinafter to the drawings and first FIG. 1 which illustrates a circuit configuration of a plasma ignition system for a four-cylinder internal combustion engine according to the present invention.

Figure 1A:
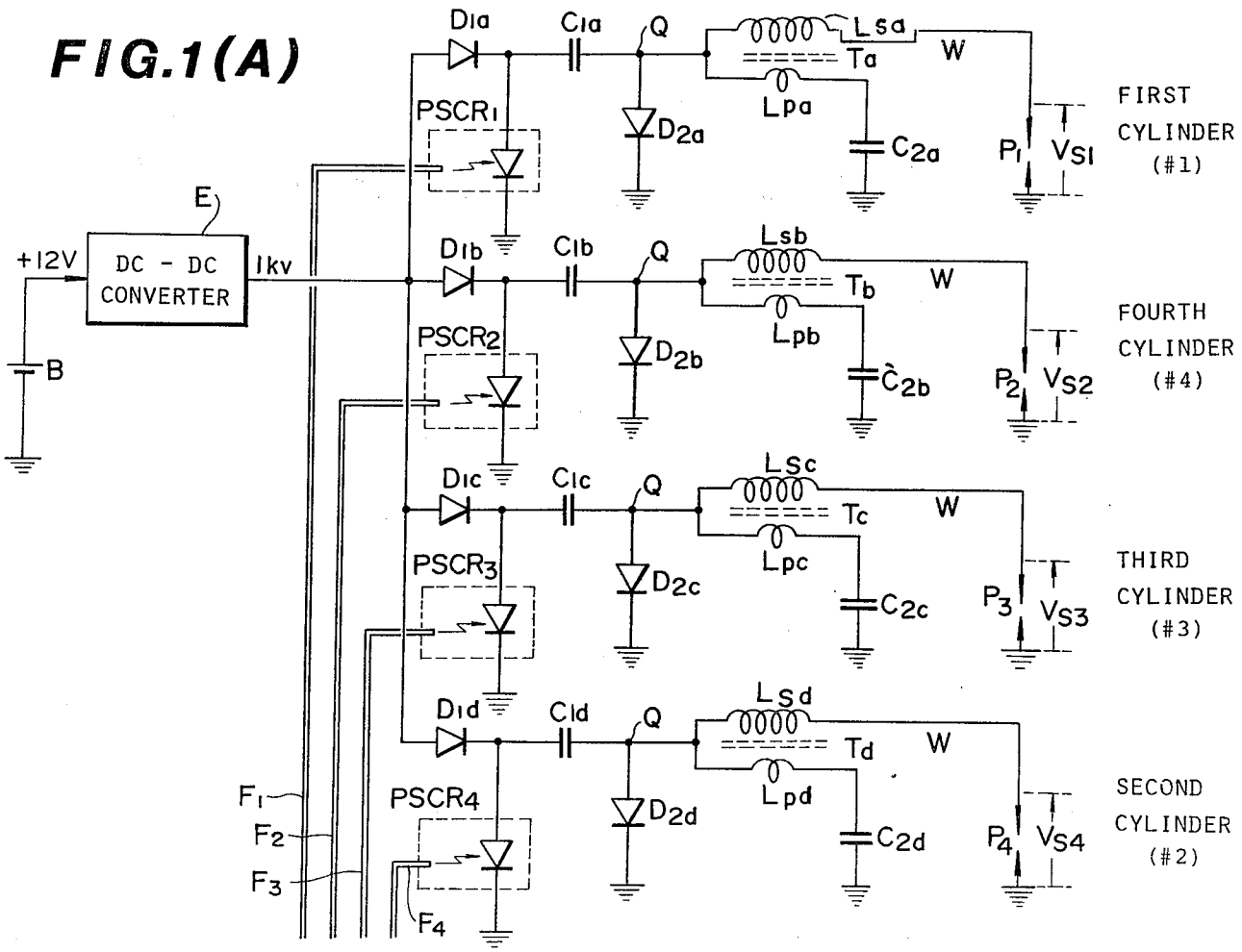
FIGS. 1(A) and 1(B) show a preferred embodiment of a plasma ignition system according to the present invention.
Figure 1B:
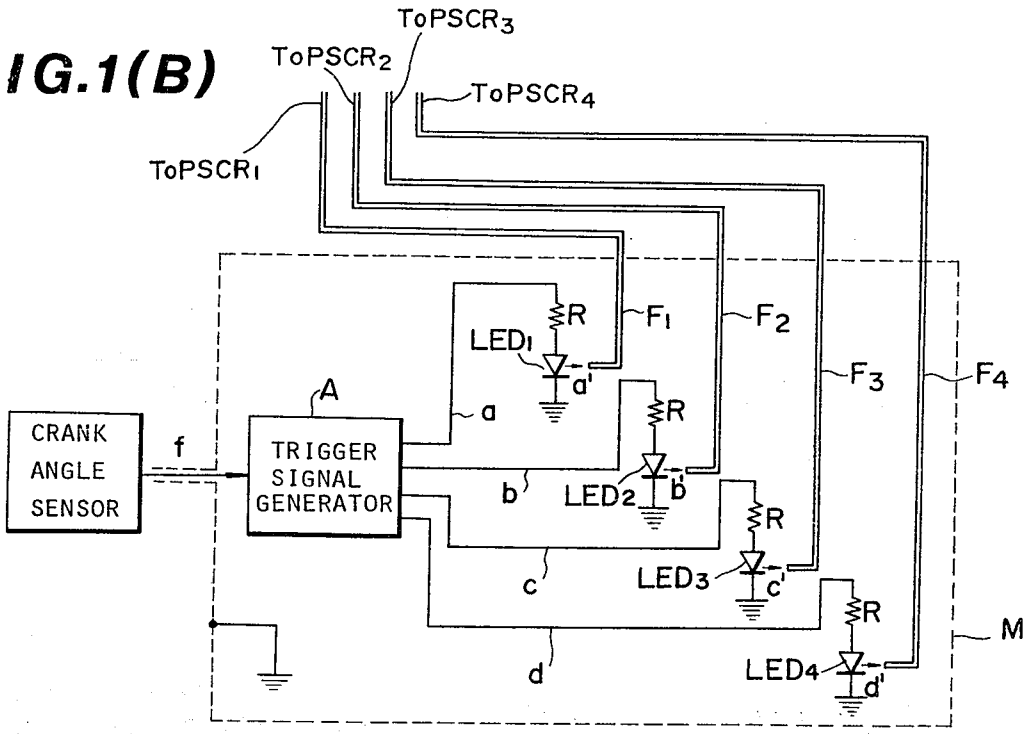

In FIGS. 1(A) and 1(B), symbol E denotes a DC—DC converter, connected to a low DC voltage supply B, for boosting the low DC voltage, e.g., 12V upto a high DC voltage, e.g., 1000 V through an oscillation action. The construction of the DC—DC converter E is well known to those skilled in the art. Symbols $D_{1a}$ through $D_{1d}$ denote four reverse-blocking diodes whose anode terminals are connected to the output terminal of the DC—DC converter E. Symbols $C_{1a}$ through $C_{1d}$ denote capacitors each for charging a plasma ignition energy fed from the DC—DC converter E via the corresponding diode $D_{1a}$ through $D_{1d}$. Symbols $T_a$ through $T_d$ denote voltage-boosting transformers each having a common terminal connected between one terminal of the primary and secondary windings $L_p$ and $L_s$, each other terminal of the secondary winding $L_{sa}$ through $L_{sd}$ grounded via an auxiliary capacitor $C_{2a}$ through $C_{2d}$ and each other terminal of the primary winding $L_{pa}$ through $L_{pd}$ connected to a plasma ignition plug $P_1$ through $P_2$ to be described hereinafter located within each cylinder. Symbols $D_{2a}$ through $D_{2d}$ denote four diodes, each anode terminal connected to one terminal of each ignition energy capacitor $C_{1a}$ through $C_{1d}$ and each cathode terminal grounded, for governing a passage of plasma ignition energy. Symbols $PSCR_1$ through $PSCR_2$ denote photo-thyristors each anode terminal thereof connected to the other terminal of each ignition energy capacitor $C_{1a}$ through $C_{1d}$ and cathode terminal grounded. Symbols $F_1$ through $F_4$ denote four optical fibers each connected between a light emitting element, i.e., a light emitting diode (LED) $LED_1$ through $LED_4$ and a gate terminal of the corresponding thyristor $PSCR_1$ through $PSCR_4$. Symbol R denotes a resistor. Symbol A denotes a trigger signal generator whose output terminals are connected to anode terminals of the light emitting diodes $LED_1$ through $LED_4$ via the respective resistors R, cathode terminals thereof being grounded. The trigger signal generator A, in general, comprises a multibit ring counter capable of handling a plurality of bits whose number depends on the number of cylinders and monostable multivibrators, having an equal number to the bits of the ring counter, which output trigger pulses a, b, c, and d on the rising edge of each bit signal from the ring counter shown in FIG. 2 with a width of 0.5 mS depending on which bit of the ring counter outputs the bit pulse, connected to a sensor for outputting a serial pulse signal f shown in FIG. 2 for providing a plasma ignition timing, e.g., crank angle sensor which outputs a serial pulse f whenever an engine crankshaft of the engine rotates 180 degress in the case of the four-cylinder engine. In the case of a six-cylinder engine, the sensor outputs a serial pulse whenever the engine crankshaft rotates 120 degrees. Symbol M denotes a shielded member comprising a shielded wire provided for a signal line between the sensor and trigger signal generator A.

In FIGS. 1(A) and 1(B), after the high DC voltage generated by the DC-DC converter E is charged within each capacitor $C_{1a}$ through $C_{1d}$ through the corresponding reverse-blocking diode $D_{1a}$ through $D_{1d}$ and the corresponding auxiliary diode $D_{2a}$ through $D_{2d}$ which, at this time, grounds one terminal of each capacitor $C_{1a}$ through $C_{1d}$, one of the photo-thyristors $PSCR_1$ through $PSCR_4$ turns on in response to a light signal (optical signal) from the corresponding light emitting diode $LED_1$ through $LED_4$ via the corresponding optical fiber $F_1$ through $F_4$ which emits light when a pulse signal having a width of 0.5 mS is received from the trigger signal generator A. At this time, a voltage at a point Q shown in FIG. 1(A) rapidly changes from zero to the negatively high DC voltage (e.g., 1000 volts). This voltage change is applied to the corresponding voltage-boosting transformer $T_a$ through $T_d$, at a primary circuit formed by the primary winding $L_{pa}$ through $L_{Pd}$ and auxiliary capacitor $C_{2a}$ through $C_{2d}$ of which a transient phenomenon of damping oscillation expressed in such a equation that $$f_p \text{ (frequency)} \approx \frac{1}{2\pi\sqrt{L_p \cdot C_2}}$$

Figure 2:
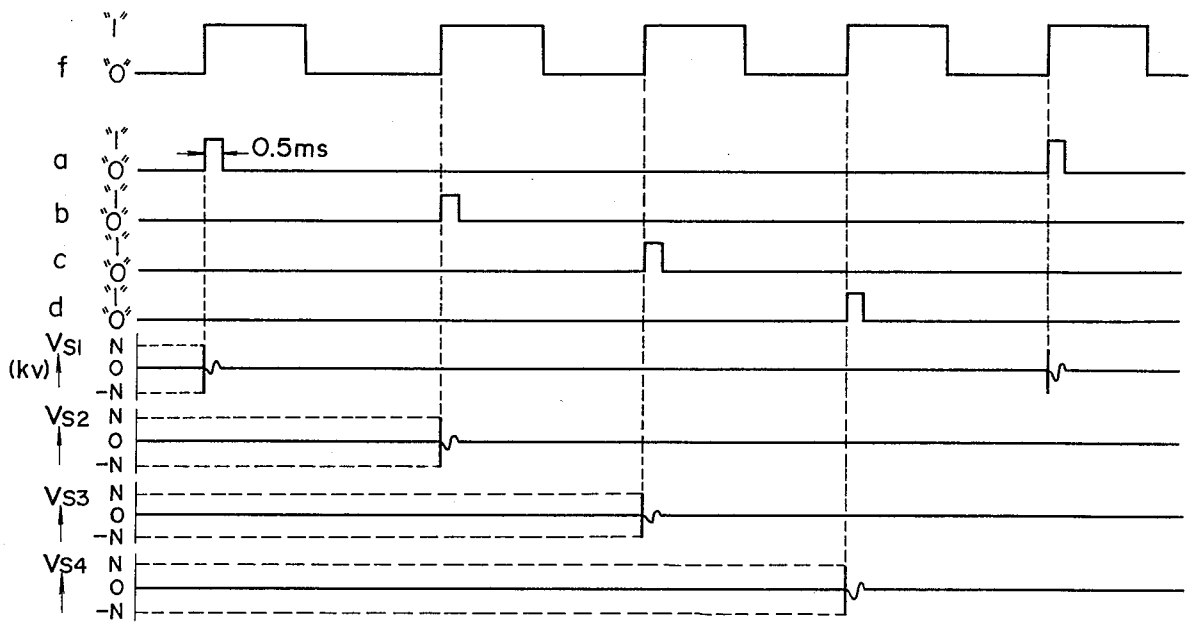
FIG. 2 shows a signal timing chart of each circuit in the plasma ignition system shown in FIG. 1.

(where $L_p$ denotes any one of the primary windings of the voltage-boosting transformers $T_{1a}$ through $T_{1d}$ and $C_2$ denotes any one of the auxiliary capacitors $C_{2a}$ through $C_{2d}$). Consequently, a damped AC voltage is generated having a frequency $f_1$ and maximum amplitude (,e.g., ± 1000 volts). The voltage generated at the primary winding $L_p$ of the transformer $T_a$ through $T_d$ is further boosted according to the widning ratio N between the secondary winding $L_s$ and the primary winding $L_p$ at the secondary winding $L_s$. The AC voltage boosted by N at the secondary winding $L_s$ of the transformer T is applied, as shown in FIG. 2, to the corresponding plasma ignition plug $P_1$ through $P_4$. In the plasma ignition plug $P_1$ through $P_4$, an electric breakdown is produced between central electrode and grounded side electrode to reduce a resistance of the plug $P_1$ through $P_4$ in a conduction state, so that a plasma gas is injected into the cylinder to ignite fuel therewithin.

Consequently, the high-voltage ignition energy charged within the corresponding capacitor $C_{1a}$ through $C_{1d}$ (about 0.5 Joules) is fed into the corresponding plasma ignition plug $P_1$ through $P_4$ in a short period of time, e.g., 0.1 mS.

A main feature in the construction of the plasma ignition system according to the present invention is, therefore, that the photo-thyristors $PSCR_1$ through $PSCR_4$ as photo-sensitive switching elements are used as electrical switching elements of the switching circuits as described hereinbefore and accordingly the electrical trigger signals a, b, c, and d generated sequencially from the electrical trigger signal generator A are converted into light trigger signals a', b', c', and d' by means of the light emitting diodes $LED_1$ through $LED_4$ as light emitting elements for the photo-thyristors $PSCR_1$ through $PSCR_4$, respectively, so that each of the light trigger signals a', b', c', and d' is sent via the corresponding optical fiber $F_1$ through $F_4$ into the corresponding photo-thyristor $PSCR_1$ through $PSCR_4$.

Figure 3A:
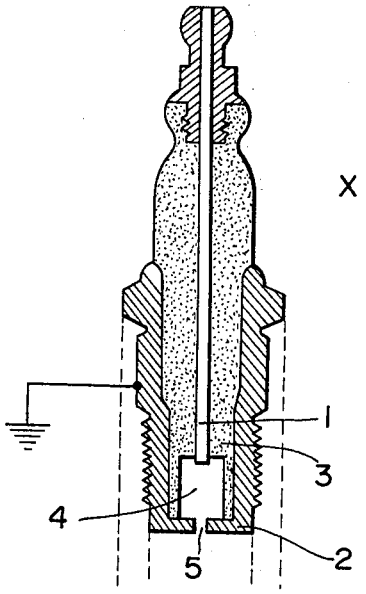
FIGS. 3(A) and 3(B) show an example of a plasma spark plug used in the plasma ignition system shown in FIG. 1.
Figure 3B:
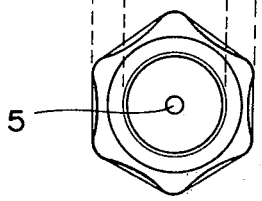

FIGS. 3(A) and 3(B) show an example of the plasma ignition plugs $P_1$ through $P_4$ used for the plasma ignition system according to the present invention.

FIG. 3(A), section X, is a longitudinally sectioned side view and FIG. 3(B), section Y, is a bottom view of each plasma ignition plug $P_1$ through $P_4$. The plasma ignition plug $P_1$ through $P_4$ comprises a central electrode 1 located axially at the center thereof, a side electrode located so as to enclose the central electrode thereof and having an injection hole 5 at a bottom center end thereof, an electrical insulation member 3 made of a ceramic material located between the central and side electrodes so as to provide a discharge gap 4 of small volume (approximately in several milimeter square) near the injection hole 5 provided at the side electrode 2. When a high-voltage energy in the order of approximately 0.5 joules is supplied between the two electrodes 1 and 2, a plasma gas is generated within the discharge gap 4 and injected through the injection hole 5 into a combustion chamber of the corresponding cylinder.

It will be appreciated that although the plasma ignition system described with reference to FIGS. 1(A), 1(B), and FIG. 2 is applied to the four-cylinder engine, the plasma ignition system according to the present invention can be applied equally to an internal combustion engine having every number of cylinders.

It will be noted that a monostable multivibrator is provided in parallel with the trigger signal generator A so that the pulse signal from the sensor is also sent into the monostable multivibrator which outputs a pulse signal for halting an oscillation action of the DC-DC converter E at a certain interval.

As described hereinabove, since photo-thyristors are used as switching elements of the switching circuits for controlling the supply timing of the high-voltage plasma ignition energy into the corresponding plasma ignition plug, and accordingly light trigger signals for the photo-thyristors are used, false triggering for the switching units due to a high-level noise generated when any plasma ignition plug is ignited can be prevented and consequently a fuel combustion by each plasma ignition plug can be assured at a predetermined ignition timing.

It will be fully understood by those skilled in the art that modifications can be made without departing the scope and spirit of the present invention, which is to be defined by the appended claims.

What is claimed is:

1. A plasma ignition system for an internal combustion engine having a plurality of cylinders, comprising:

(a) a plasma ignition plug located within each corresponding cylinder and having a central electrode and grounded side electrode;

(b) a DC-DC converter for boosting a low DC voltage supplied thereinto to a high DC voltage;

(c) a plurality of plasma ignition energy capacitors, each for charging the high DC voltage received from said DC-DC converter;

(d) a plurality of photo-sensitive switching elements, each connected between one terminal of each corresponding plasma ignition energy capacitor and ground which turns on to apply the plasma ignition energy charged within said corresponding plasma ignition energy capacitor to the corresponding plasma ignition plug in response to a light trigger signal received thereat;

(e) a plurality of voltage-boosting transformers, each having a common terminal of primary and secondary windings connected to the other terminal of each corresponding plasma ignition energy capacitor and another terminal of the primary winding connected to said corresponding plasma ignition plug for boosting the voltage across the corresponding plasma ignition energy capacitor to a still higher voltage at the secondary winding thereof depending on the winding ratio between the primary and secondary windings;

(f) an auxiliary capacitor connected between another terminal of said secondary winding of each voltageboosting transformer and ground so as to form an oscillation circuit together with the primary winding of said corresponding voltage-boosting transformer;

(g) an ignition timing signal generator which produces and sequencially outputs an electrical ignition timing signal for each cylinder at a predetermined timing according to the engine revolution; and (h) a plurality of light emitting elements, each connected to said ignition timing signal generator and which emits a light signal for triggering said corresponding photo-sensitive switching element to turn on in response to the electrical ignition timing signal from said ignition timing signal generator.

2. A plasma ignition system as set forth in claim 1, which further comprises a plurality of optical fibers, each connected optically between the corresponding photosensitive and light emitting elements.

3. A plasma ignition system as set forth in either claim 1 or claim 2, which further comprises:

(a) a plurality of first diodes each connected between said DC-DC converter and one terminal of corresponding plasma ignition energy capacitor for preventing the plasma ignition energy charged within said corresponding plasma ignition energy capacitor from reversely flowing into said DC-DC converter; and (b) a plurality of second diodes, each connected between the other terminal of said corresponding plasma ignition energy capacitor and ground for grounding the other terminal of said corresponding plasma ignition energy capacitor only when said corresponding plasma ignition energy capacitor is charged.

4. A plasma ignition system as set forth in claim 3, which further comprises a shielding member located so as to enclose said plasma ignition timing signal generator and light emitting elements for electrically shielding said ignition timing signal generator and light emitting elements from an external high-level noise generated when one of the plasma ignition plugs is ignited.

5. A plasma ignition system as set forth in claim 3, wherein said photo-sensitive switching elements are photothyristors.

6. A plasma ignition system as set forth in claim 5, wherein said light emitting elements are light emitting diodes each of which is electrically connected between said ignition timing signal generator via a resistor and ground and optically connected to each corresponding photothyristor via said corresponding optical fiber.

* * * * *